US012410705B2

(12) United States Patent
Lavoie et al.

(10) Patent No.: US 12,410,705 B2
(45) Date of Patent: Sep. 9, 2025

(54) SYSTEM AND METHOD OF MONITORING FRACTURING IN GEOTHERMAL SYSTEMS

(71) Applicant: RESMAN AS, Ranheim (NO)

(72) Inventors: Scott Lavoie, The Woodlands, TX (US); Bonnie Powell, Houston, TX (US); Sven Kristian Hartvig, Raelingen (NO); Edmund Leung, Karrinyup (AU); Roy Greig, Aberdeen (GB)

(73) Assignee: Resman AS, Ranheim (NO)

( * ) Notice: Subject to any disclaimer, the term of this patent is extended or adjusted under 35 U.S.C. 154(b) by 0 days.

(21) Appl. No.: 18/527,815

(22) Filed: Dec. 4, 2023

(65) Prior Publication Data

US 2025/0179911 A1 Jun. 5, 2025

(51) Int. Cl.
*E21B 47/11* (2012.01)
*E21B 49/08* (2006.01)

(52) U.S. Cl.
CPC ..... *E21B 47/11* (2020.05); *E21B 49/08* (2013.01)

(58) Field of Classification Search
CPC ..... E21B 47/11; E21B 43/34; C09K 8/34
USPC ..... 166/250.12
See application file for complete search history.

(56) References Cited

U.S. PATENT DOCUMENTS 8,959,991 B2 * 2/2015 Pissarenko ..... G01V 11/002 73/152.55
10,106,727 B2 * 10/2018 Cannan ..... E21B 47/11
10,465,502 B2 * 11/2019 El-Khazindar ..... E21B 47/11
11,294,349 B1 * 4/2022 Dewers ..... E21B 43/267
2010/0032156 A1 2/2010 Petty et al.
2020/0123896 A1 * 4/2020 Smithson ..... E21B 47/11
2022/0186609 A1 6/2022 Bigno

FOREIGN PATENT DOCUMENTS

AU 2010259936 A1 2/2012

OTHER PUBLICATIONS

Mohamed Lofty et al."The first Co-Implementation of Inflow and Inter-Well Tracers in Offshore Abu Dhabi: Towards cost Efficient Reservoir Monitoring and Management" SPE Paper Nov. 2020, Paper No. SPE-203132-MS See Abstract https://doi.org/10.2118/203132-MS;.

Pedram Mahzari et al—"Characterising fluid flow paths in the Hellisheidi geothermal field using detailed fault mapping and stress-dependent permeability" Geothermics 2021.

(Continued)

*Primary Examiner* — William D Hutton, Jr.
*Assistant Examiner* — Ashish K Varma
(74) *Attorney, Agent, or Firm* — FisherBroyles, LLP

(57) ABSTRACT

The invention may provide a method and system of characterising at least one fracture in an enhanced geothermal system. The method comprises arranging two or more tracer sources with distinct tracer materials in known levels of a production well of the enhanced geothermal system. The method comprises injecting at least one tracer into the at least one fracture in the injection well, producing fluid in the production well, collecting samples of produced fluid and analysing the samples for the presence and/or concentration of tracers. Based on the presence and/or concentration of tracers in the samples estimating at least one characteristic of the at least one fracture.

23 Claims, 5 Drawing Sheets

(56) References Cited

OTHER PUBLICATIONS

Ibrahim Kocabas "Geothermal reservoir characterisation via thermal injection backflow and interwell tracer testing" Geothermics 2025.
Wurtz M et al.: "Interwell and inflow gas tracersoverview and applications", Eage Wipic Workshop: Reservoir Management in Carbonates, Mar. 21, 2022 (Mar. 21, 2022).

* cited by examiner

SYSTEM AND METHOD OF MONITORING FRACTURING IN GEOTHERMAL SYSTEMS

The present invention relates to monitoring geothermal systems and in particular monitoring flow of fluids in geothermal systems. Aspects of the invention relate a method of monitoring fracturing between wells in an enhanced geothermal system.

BACKGROUND TO THE INVENTION

A geothermal reservoir is a naturally occurring area of hydrothermal resources providing heat, water, and rock permeability sufficient to allow energy extraction. These reservoirs are deep underground and are largely undetectable above ground. A geothermal production well is drilled into a known geothermal reservoir and hot geothermal fluids flow through the production well to a power plant for use in generating electricity. An injection well is drilled into the known geothermal reservoir to return used geothermal fluids to the geothermal reservoir. A geothermal reservoir may be in communication with multiple injector and/or production wells.

An enhanced geothermal system (EGS) generates geothermal electricity without natural convective hydrothermal resources. In many areas, subterranean rock is hot but there is not enough natural permeability or fluids present to allow the generation of electricity. An enhanced geothermal system may be used create a human-made reservoir to extract heat for electricity production.

In an enhanced geothermal system, a first well (injection well) is drilled and hydraulic, thermal, or chemical stimulation is conducted deep underground under carefully controlled conditions to create fluid connectivity in initially low-permeability rocks by creating fractures or reopening pre-existing fractures between the first well and a second well. Fluid is pumped in the first well through the fractures in the hot rock heating the fluid which is circulated back to surface via the second well where it is used to generate electricity.

In order to maximise energy output of the enhanced geothermal system it is important to understand the fluid connections between the first well and the second well and the geometry of the fractures.

SUMMARY OF THE INVENTION

It is amongst the aims and objects of the invention to provide a system and method which obviates or mitigates one or more drawbacks or disadvantages of the prior art enhanced geothermal systems.

There is a need to obtain information on fluid flow into, through and from an injection well to at least one production well through an enhanced geothermal system.

There is generally a need for a system and method to identify flow paths of fluid injected into fractures of an enhanced geothermal system to understand fluid migration into, through and from an enhanced geothermal system.

It is an object of the invention to provide a system and method to obtain information on the fracture connectivity, fracture volume and/or fracture surface area through the enhanced geothermal system. This may allow energy production from an enhanced geothermal system to be monitored and/or optimised.

It is another object of an aspect of the present invention to characterise fractures from the injection well to determine fracture permeability, fracture volume and/or fracture surface area.

It is another object of an aspect of the present invention to determine an optimal location and/or depth of a production well to connect to at least one high permeability fracture.

Further aims and objects of the invention will become apparent from reading the following description.

According to a first aspect of the invention, there is provided a method of characterising at least one fracture in an enhanced geothermal system, the method comprising:

- arranging two or more tracer sources with distinct tracer materials in known levels of a production well of the enhanced geothermal system;
- injecting at least one tracer into the at least one fracture in an injection well;
- producing fluid in the production well;
- collecting samples of produced fluid;
- analysing the samples for the presence and/or concentration of tracers; and
- based on the presence and/or concentration of tracers in the samples estimating and/or
- calculating at least one characteristic of the at least one fracture.

The at least one tracer may be an interwell tracer. The two or more tracer sources with distinct tracer materials may be inflow tracers. The method may comprise injecting at least one tracer into the at least one fracture in the injection well. The injection well may comprise two or more fractures. The method may comprise injecting at least one distinct tracer into each fracture.

The enhanced geothermal system may comprise at least one injection well and at least one production well. The enhanced geothermal system may comprise two or more injection wells. The enhanced geothermal system may comprise two or more production wells.

The method may comprise injecting the at least one tracer into a well before, during and/or after a well stimulation treatment. The method may comprise injecting the at least one tracer with a well treatment to create at least one fracture. The method may comprise injecting the at least one tracer during the creation of the at least one fracture. The method may comprise injecting the at least one tracer into the at least one fracture after the at least one fracture has formed.

The method may comprise injecting the at least one tracer into the injection well or at least one fracture from surface. The method may comprise injecting the at least one tracer into the injection well or at least one fracture from a downhole device. The method may comprise injecting the at least one tracer into the injection well or at least one fracture from a tracer source installed, arranged or positioned in the injection well. The at least one tracer may be installed, arranged or positioned in the injection well. The method may comprise introducing the at least one tracer into the well by releasing the tracer from installed, arranged or positioned tracer source in the well. Each of the at least one tracers may be installed, arranged or positioned as a tracer source in the well in the vicinity of a well stimulation treatment zone. The method may comprise releasing the at least one tracer from the tracer source into the injection well. The at least one tracer may be released or injected into the injection fluid via a tracer injection device. The tracer injection device may be permanently installed in a well or injection site. The method may comprise pumping the released at least one tracer into the at least one fracture.

The well stimulation treatment may be selected from the group comprising acidizing treatment, matrix acidizing treatment, fracturing treatment, hydraulic fracturing treatment and/or fracture acidizing treatment.

The at least one tracer may be premixed with a well stimulation treatment fluid and/or injection fluid. The at least one tracer may be co-injected with a well stimulation treatment fluid and/or injection fluid. The at least one tracer may be added to the well stimulation treatment fluid and/or injection fluid. The least one tracer and the well stimulation treatment fluid and/or injection fluid may be introduced or released into the injection well.

The least one tracer may be co-released with the well stimulation treatment fluid and/or injection fluid.

The at least one tracer may be a chemical tracer. The at least one tracer may be a non-radioactive tracer. The at least one tracer may be injected with or comprise a proppant. The at least one tracer may be configured to release at a known rate from proppant or proppant particles.

The at least one tracer may be selected from the group comprising chemical, fluorescent, phosphorescent and radioactive compounds isotope, isotope signature, stable isotope and/or radioactive isotope of elements constituting a part of a tracer molecule. The at least one tracer may comprise stable or radioactive isotopes of elements constituting a part of a tracer molecule. The at least one tracer may be a water tracer. The at least one tracer may be a solid, liquid or gas. The at least one tracer may be applied in solution. The at least one tracer may be in a semi-crystalline or crystalline form. The at least one interwell tracer may be configured to be soluble and/or dissolve in water. The at least one interwell tracer may be a perfluorinated compounds. The at least one tracer may be an organofluorine compound with hydrogen replaced by fluorine. The at least one tracer may be a perfluorocarbon. The at least one tracer may be perfluoromethylcyclohexane. The at least one tracer may be a nanoparticle. The at least one tracer may be a quantum dot. The at least one tracer may be a naphthalene sulphonic acid.

The at least one tracer may comprise at least one cation. The at least one tracer may comprise at least one organic cation and/or at least one inorganic cation. The at least one tracer may comprise two or more cations. The at least one cation may be selected from the group comprising Cs, Rb, K, Li and/or Na. The at least one cation may be an alkaline earth metal cation. The at least one cation may be a cation of Mg, Ca, Sr, Ba and/or mixtures thereof. The at least one cation an alkali metal cation. The at least one cation may be a cation of Li, Na and/or K. The at least one cation may be a cation of ammonium, alkylammonium, pyridine and/or substituted pyridine cations. The at least one cation may be a cation of Pb, Zn and/or Ag.

The at least one tracer may comprise at least one anion. The at least one anion may be selected from the group comprising CI, B, F and/or I. The at least one tracer may comprise at least one organic anion and/or at least one inorganic anion. The at least one tracer may comprise an inorganic anionic metal complex. The metal of said inorganic anionic complex is a metal selected from the groups comprising 4, 5, 6, 7, 9 or 16 of the periodic table. The metal may be selected from the group comprising of Se, Ti, Zr, Hf, V, Nb, Ta, Cr, Mo, W, Mn, Tc, Re, Co, Rh and Ir. The metal may be a group VI or a group VII metal, such as Mo, W or Re. The inorganic anionic metal complex may be a complex of a metal with at least one anionic ligand selected from oxide, hydroxide, halide (e.g. fluoride, chloride, bromide or iodide), thiocyanate, and/or cyanide. The complex may comprise one or more ligands of the same sort, or two or more different ligands. The ligands in the anionic metal complex may be inorganic.

By arranging two or more tracer sources it is meant locating, positioning or installing the two or more tracer sources with distinct tracer materials in known levels of a production well. The two or more tracer sources are preferably inflow tracers. The method may comprise arranging two or more inflow tracer sources with distinct tracer materials in known levels of a production well. The method may comprise arranging an array of inflow tracer sources with distinct tracer materials in the production well. Each tracer in the array may be arranged at a known level, depth or position in the production well.

The tracer material may comprise a tracer and a carrier. The carrier may be a matrix material. The matrix material may be a polymeric material. The tracer may be chemically immobilized within and/or to the carrier. The tracer material may be chemically immobilized and configured to release tracer molecules or particles in the presence of a chemical trigger or specific fluid.

The carrier may be a polymer. The tracer may be physically dispersed and/or physically encapsulated in the carrier. The tracer material may release tracer molecules into fluid by dissolution or degradation of the carrier and/or the tracer into the produced fluid.

The carrier may be selected to controllable degrade on contact with the produced fluid into the production well. The carrier may be selected to degrade by hydrolysis of the carrier. The tracer and/or the carrier may be fluid specific such that the tracer molecules will be released from the tracer material as a response to a contact with a target liquid such as the injection fluid or produced fluid. The tracers and/or the carrier may be chemically intelligent such that tracer molecules will be released from the tracer material as a response the exposure of the tracer material to a target fluid. Each of the tracer release device may be configured to release one distinct tracer. Each of the tracer release device may be configured to release two or more distinct tracers. The at least one tracer may be a liquid, solid or gas. The at least one tracer may be a powdered solid.

The two or more tracer sources with distinct tracer material may be selected from the group comprising chemical, fluorescent, phosphorescent, magnetic, DNA and radioactive compounds. The tracer material may comprise chemical tracers selected from the group comprising perfluorinated hydrocarbons or perfluoroethers. The perfluorinated hydrocarbons may be selected from the group of perfluoro buthane (PB), perfluoro methyl cyclopentane (PMCP), perfluoro methyl cyclohexane (PMCH). The tracer material may comprise polyfunctionalized polyethylene or polypropylene glycols. The tracer material may be an inflow tracer.

The at least one tracer and/or the two or more tracer sources with distinct tracer material may be a water tracer.

The fluid flowing through the at least one fracture may be at least 374° C. The fluid flowing through the at least one fracture may be at least 100° C. The fluid flowing through the at least one fracture may be at least 200° C. The fluid flowing through the at least one fracture may be at least 250° C. The fluid flowing through the at least one fracture may be at least 300° C. The fluid flowing through the at least one fracture may be at least 350° C. The fluid flowing through the at least one fracture may be a supercritical fluid. The fluid flowing through the at least one fracture may be in the range of 374° C. to 500° C. The fluid flowing through the at least one fracture in the range of 374° C. to 450° C. The fluid flowing through the at least one fracture may be in the range of 374° C. to 400° C. The produced fluid may be in the range of 100° C. to 500° C. The produced fluid may be in the range of 374° C. to 450° C. The produced fluid may be in the range of 374° C. to 400° C. The at least one interwell tracer may be stable at a temperature in the range of 100° C. to 500° C. The at least one interwell tracer may be stable at a temperature in the range of 100° C. to 400° C. more. The at least one interwell tracer may be stable at a temperature of 250° C. or more. By 'stable' is meant the at least one tracer is still functional as a tracer or interwell tracer. The two or more tracer sources (inflow tracer) may be stable at a temperature in the range of 100° C. to 500° C. The two or more tracer sources (inflow tracer) may be stable at a temperature in the range of 100° C. to 400° C. more. The two or more tracer sources (inflow tracer) may be stable at a temperature of 250° C. or more. By 'stable' is meant the two or more tracer sources are thermally stable and still functional as a tracer or inflow tracers.

The interwell tracer and/or inflow tracers and/or carrier may be stable at a temperature in the range of 100° C. to 500° C. The interwell tracer and/or inflow tracers and/or carrier may be stable at a temperature in the range of 100° C. to 400° C. more. The interwell tracer and/or inflow tracers and/or carrier may be stable at a temperature of 250° C. or more. By 'stable' is meant the interwell tracer and/or inflow tracers and/or carrier are thermally stable and still functional as tracers or as a tracer carrier.

The method may comprise adjusting and/or controlling the duration and/or frequency of the injection or release of the at least one tracer into the at least one fracture. The method may comprise controlling and/or adjusting the release of tracer into at least one injection fluid for a desired duration and/or frequency. The method may comprise injecting or releasing tracer continuously. The method may comprise injecting or releasing tracer continuously for a sustained period of time. The method may comprise actuating a tracer injection device to allow continuous release of tracer. This may allow continuous monitoring of the geothermal system.

The method may comprise identifying at least one tracer injected into the fracture in the samples. The method may comprise identifying at least one interwell tracer injected into the fracture in the samples. The method may comprise identifying at least one distinct tracer materials from one or more tracer sources in the samples. The method may comprise identifying at least one inflow tracer in the samples.

The method may comprise identifying, tracing and/or mapping flow paths and/or transport paths of the at least one tracer injected into the at least one fracture. The method may comprise identifying, tracing and/or mapping flow paths of the at least one fracture.

The method may comprise identifying, tracing and/or mapping flow though the at least one fracture.

The method may comprise tracing and/or mapping flow between at least one injection well and at least one production well based on the presence and/or concentration of the at least one tracer. The method may comprise determining which injection well and/or which fracture is the source of fluid produced at a production well based on the presence and/or concentration of the at least one tracer. The method may comprise determining which production well is producing fluid injected into the at least one fracture in an injection well based on the presence and/or concentration of the at least one tracer.

The method may comprise identifying inflow or breakthrough into a production well based on the presence and/or concentration of the tracer from the two or more tracer sources or inflow tracers. The method may comprise identifying an inflow location, position or depth in the production well or mapping flow between at least one injection well and at least one production well based on the presence and/or concentration of the tracer from the two or more tracer sources or inflow tracers.

The method may comprise determining a fracture flow path based on the presence and/or concentration in the samples of the at least one tracer injected at least one fracture and the presence and/or concentration in the samples of the two or more tracer material or inflow tracers positioned in the production well.

The method may comprise characterising one or more breakthroughs into a production well based on the presence of tracers in the samples.

The method may comprise estimating and/or calculating at least one characteristic of the at least one fracture selected from the group comprising breakthrough location, breakthrough depth, fracture length, flow velocity, fracture flow path, surface area, cross-sectional area, fracture volume, heating capacity, permeability, flow characteristics, flow path and/or an optimal production well location. The method may comprise identifying at least one breakthrough location and/or depth in a production well. The method may comprise characterising at least one breakthrough location and/or depth in a production well.

The method may comprise calculating a fracture length from a tracer injection point to the at least one breakthrough location. The method may comprise calculating a flow velocity though the at least one fracture. The method may comprise calculating a cross-sectional area of the at least one fracture. The method may comprise calculating a fracture volume of the at least one fracture.

The method may comprise injecting an injection fluid with a first tracer into a first fracture at a first injection time. The method may comprise injecting an injection fluid with a second tracer into a second fracture at a second injection time. The first tracer and/or second tracer may be different tracer types.

The method may comprise obtaining produced fluid from at least one production well. The method may comprise collecting samples of the produced fluid. The method may comprise collecting samples of the injection fluid. The sampling may be conducted at one or more sampling times. The sampling may be conducted downhole in a production well. The sampling may be conducted at surface. The sampling may be conducted at a location in a direction towards the surface of the production well. Samples may be collected for later analysis. The collected samples may be further analysed onsite or offsite. The method may comprise in-line sampling. The method may comprise detecting the presence and/or concentration of tracer in the produced fluid. The method may comprise detecting the presence and/or concentration of tracer in the produced fluid in real time. The method may comprise detecting the presence and/or concentration of tracer in the produced fluid using an online analyser. The method may comprise measuring a concentration of at least one tracer in the produced fluid. The method may comprise measuring a concentration of at least one tracer in the produced fluid in real time. The method may comprise measuring a concentration of at least one tracer in the produced fluid using an online analyser. The sample collection may be an automated process.

The method may comprise storing collected samples in a storage device. The method may comprise storing collected samples in a storage device for export to a laboratory and/or later analysis. The samples may be stored by adsorbing them to a chemical adsorption tube (CAT). The method may comprise collecting the at least one sample in at least one sample container or sampling tube. The method may comprise collecting the at least one sample in a sample container such as PVT sample canisters or isotubes. The method may comprise collecting the at least one sample in at least one sampling tube comprising a sorbent material. The sorbent material may be configured to adsorb the at least one tracer. The sorbent material may be configured to adsorb tracer from the two or more tracer sources. The sorbent material may be configured to adsorb at least one interwell tracer. The sorbent material may be configured to adsorb at least one inflow tracer. The method may comprise extracting the at least one tracer from the sample to the sorbent material. The method may comprise storing and/or transporting the sorbent material. The method may comprise storing and/or transporting the sorbent material for later analysis.

The method may comprise determining the type of tracer or tracers in the sample. The method may comprise measuring and/or monitoring the concentration of tracer. The method may comprise the measuring and/or monitoring the transport time of the at least one tracer. The method may comprise the measuring and/or monitoring the transport time of the at least one tracer from injection to detection in the produced fluid.

The at least one tracer may be detected and/or measured using techniques selected from the group comprising optical detection, optical fibers, spectrophotometric methods, spectrometric methods, fluorescence, chromatographic methods, HPLC (high performance liquid chromatography), MS (mass spectrometry) inductively coupled plasma mass spectrometry (ICP-MS), mass spectroscopy (MS) or multidimensional MS and/or radioactivity analysis.

The method may comprise injecting and/or releasing at least one tracer in two or more injection wells. The method may comprise injecting or releasing at least one tracer in two or more injection wells. The method may comprise analysing the arrival of tracer concentration of each injected tracer in the produced fluid. The method may comprise analysing the rate of decline of the tracer concentration in the produced fluid to determine fracture flow characteristics, flow rates and/or flow paths.

The method may comprise modelling the enhanced geothermal system, tracer concentration, transport time, injection flow rate and/or production rates, one or more fracture characteristic and/or tracer flow characteristics in a model. The parameters of the model may be adjusted until calculated concentrations of model tracers compare or substantially match with the measured concentrations of tracers to estimate enhanced geothermal system characteristics and/or fracture characteristics. The method may be a computer-implemented method. The method may comprise storing the measured tracer data to a database.

The method may comprise controlling the fluid injection flow rate at one or more injection well through the at least one fracture. The method may comprise controlling the fluid injection flow rate into the injection well. The method may comprise calculating a heat equilibrium rate for at least one fracture. The method may comprise determining an injection flow rate and/or production flow rate to maintain or achieve an optimal heat equilibrium rate. The method may comprise maintaining a balanced injection flow rate and/or production flow rate once a heat equilibrium rate for the geothermal system has been achieved.

The method may comprise automatically adjusting the injection rates through the at least one fracture and/or production rates to optimise the heating capacity of the geothermal system.

By determining characteristics of the at least one fracture the heating efficiency of the geothermal system can be estimated or calculated. By tracing flow paths, transport times of fluid through at least one fracture, the surface area of the at least one fracture and/or the migration of fluid through the at least one fracture may be determined and/or the heating capacity of the enhanced geothermal system may be determined. The method may comprise determining a heating capacity of the enhanced geothermal system by estimating the surface area of the at least one fracture and/or the migration path of fluid through the at least one fracture The method may comprise characterising two or more fractures in an enhanced geothermal system. The method may comprise characterising a plurality of fractures in an enhanced geothermal system. The enhanced geothermal system may be a supercritical enhanced geothermal system.

According to a second aspect of the invention, there is provided a method of characterising at least one fracture in an enhanced geothermal system, the method comprising:

- arranging two or more tracer sources with distinct inflow tracer materials in known levels of a production well of the enhanced geothermal system;
- injecting at least one interwell tracer into the at least one fracture in the injection well;
- producing fluid in the production well;
- collecting samples of produced fluid;
- analysing the samples for the presence and/or concentration of tracers; and
- based on the presence and/or concentration of tracers in the samples estimating and/or calculating at least one characteristic of the at least one fracture.

Embodiments of the second aspect of the invention may include one or more features of the first aspect of the invention or its embodiments, or vice versa.

According to a third aspect of the invention, there is provided a method of characterising breakthrough into a production well of an enhanced geothermal system, wherein the production well comprises two or more tracer sources with distinct inflow tracer materials arranged in known levels of the production well, the method comprising:

- producing fluid in the production well;
- collecting samples of produced fluid;
- analysing the samples for the presence and/or concentration of the two or more tracers;
- based on the presence and/or concentration of tracers in the samples estimating and/or calculating a breakthrough location in the production well.

Embodiments of the third aspect of the invention may include one or more features of the first or second aspects of the invention or its embodiments, or vice versa.

According to a fourth aspect of the invention, there is provided a method of characterising at least one fracture in an enhanced geothermal system, the method comprising:

- providing measured concentrations of tracer from samples of produced fluids, the samples previously collected from a production well comprising two or more tracer sources with distinct tracer materials arranged in known levels of the production well, the samples collected after injecting at least one tracer into the at least one fracture in the injection well; and
- based on the measured concentrations of tracer estimating and/or calculating at least one characteristic of the at least one fracture.

The two or more tracer sources with distinct tracer materials may be inflow tracers. The injected at least one tracer may be an interwell tracer.

Embodiments of the fourth aspect of the invention may include one or more features of the first to third aspects of the invention or their embodiments, or vice versa.

According to a fifth aspect of the invention, there is provided a method of collecting samples for analysis in characterising at least one fracture in an enhanced geothermal system, wherein the production well comprises two or more tracer sources with distinct tracer materials arranged in known levels of the production well; wherein the geothermal system comprises at least one tracer injected into at least one fracture in an injection well;

producing fluid from the geothermal system in the production well; and collecting at least one sample of the produced fluid.

The two or more tracer sources with distinct tracer materials may be inflow tracers. The injected at least one tracer may be an interwell tracer.

Embodiments of the fifth aspect of the invention may include one or more features of the first to fourth aspects of the invention or their embodiments, or vice versa.

According to a sixth aspect of the invention there is provided an interpretation method for characterising at least one fracture in an enhanced geothermal system, wherein the enhanced geothermal system comprises a production well where two or more tracer sources with distinct tracer materials arranged in known levels of the production well;

providing tracer data, the tracer data previously measured from a production well after injecting at least one tracer into the at least one fracture in the injection well; the method comprising:

analysing the tracer data to estimate at least one characteristic of the at least one fracture.

The two or more tracer sources with distinct tracer materials may be inflow tracers. The injected at least one tracer may be an interwell tracer.

Embodiments of the sixth aspect of the invention may include one or more features of the first to fifth aspects of the invention or their embodiments, or vice versa.

According to a seventh aspect of the invention there is provided a system for characterising at least one fracture in an enhanced geothermal system comprising:

two or more tracer sources with distinct tracer materials arranged in known levels of a production well;

at least one tracer configured to be injected into the at least one fracture in an injection well; and a collection device configure to collect samples of fluid produced in the production well.

The collecting samples may be configured to collect samples at known sampling times.

The two or more tracer sources with distinct tracer materials may be inflow tracers. The injected at least one tracer may be an interwell tracer.

The system may comprise a tracer release device configured to release the at least one tracer into the injection well. The system may comprise a tracer release device configured to release the at least one tracer into the at least one fracture. The system may comprise at least one tracer analyser device configured to detect and/or measure the concentration of the at least one tracer in fluid produced from the geothermal system. The system may comprise at least one tracer analyser device configured to detect and/or measure the concentration of the two or more tracer materials in fluid produced in the production well. The system may comprise at least one tracer analyser device configured to detect and/or measure the concentration of the two or more inflow tracers in the fluids in the production well. The system may comprise at least one probe. The at least one probe may be configured to detect the concentration of the at least one tracer in fluid produced from the geothermal system. The at least one probe may be a sample collection probe, a detector probe and/or a real time detector probe. The system may comprise a tracer analyser for analysing presence, type and/or concentration of the at least one tracer.

The system may comprise a processor. The process may be a computer-implemented processor. The processor may be configured to compare a tracer type and/or concentration of measured in the production well with a tracer type and/or concentration of at least one injected interwell tracer in the injection well. The processor may be configured to compare a tracer type and/or concentration of measured in the production well with at least one inflow tracer arranged in the production well. The processor may be configured to calculate and/or monitor a characteristic of the at least one fracture based on the presence and/or concentration of tracer in the samples.

Embodiments of the seventh aspect of the invention may include one or more features of the first to sixth aspects of the invention or their embodiments, or vice versa.

According to an eighth aspect of the invention, there is provided a method of designing an enhanced geothermal system, the method comprising:

drilling an injection well;

drilling two or more test wells at known distances from the injection well;

arranging two or more tracer sources with distinct tracer materials in known levels of each of the test wells, conducting at least one well stimulation treatment in the injection well to create at least one fracture;

producing fluid in the two or more test wells and collecting samples of produced fluid;

analysing the samples for the presence and/or concentration of tracers;

based on the presence and/or concentration of tracers in the samples determining an optimum position for a production well.

The method may comprise injecting at least one tracer into the at least one fracture in the injection well. The two or more tracer sources with distinct tracer materials may be inflow tracers. The injected at least one tracer may be an interwell tracer.

The method may comprise drilling the production well at a position of one of the two or more test wells. The method may comprise determining or calculating at least one characteristic of the one or more fracture between the injection well and at least one of the two or more test wells. The method may comprise determining or calculating at least one characteristic of the at least one fracture selected from the group comprising breakthrough location, fracture length, flow velocity, cross-sectional area, fracture volume, heating capacity, permeability, flow characteristics, flow path, optimal production well location. The method may comprise locating the production well at a maximum fracture length from the injection well. The method may comprise locating the production well at a maximum fracture length from the injection well where there is a high fracture volume and/or permeability.

The method may comprise controlling and/or optimising the rate of injection and/or rate of producing fluid from the geothermal system based on measured concentration of the at least one tracer.

Embodiments of the eighth aspect of the invention may include one or more features of the first to seventh aspects of the invention or their embodiments, or vice versa.

According to a ninth aspect of the invention, there is provided a method of characterising at least one fracture in an enhanced geothermal system, wherein the production well comprises two or more tracer sources with distinct inflow tracer materials arranged in known levels of the production well, the method comprising:

injecting at least one tracer into the at least one fracture in an injection well;

producing fluid in the production well;

collecting samples of produced fluid;

analysing the samples for the presence and/or concentration of tracers; and based on the presence and/or concentration of tracers in the samples estimating and/or calculating at least one characteristic of the at least one fracture.

The two or more tracer sources with distinct tracer materials may be inflow tracers. The injected at least one tracer may be an interwell tracer.

Embodiments of the ninth aspect of the invention may include one or more features of the first to eighth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1:
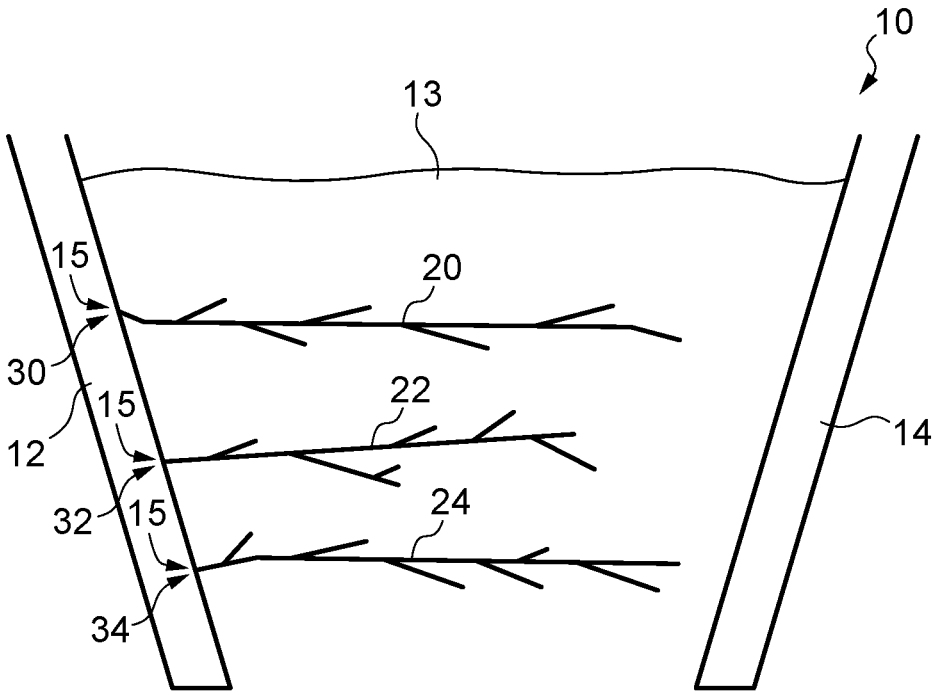
FIG. 1 is a simplified representation of an enhanced geothermal system in accordance with an aspect of the invention.

FIG. 1 is a simplified representation of an enhanced geothermal system according to the invention shown generally as 10. The geothermal system has an injection well 12 and a production well 14. A series of hydraulic, thermal, or chemical stimulation treatments are carried out in the injection well with the aim of establishing a fluid connection between the injection well and the production well through the hot rocks 13. In this example hydraulic fracturing is carried out at three difference depths of the injection well. Fracturing fluid 15 is pumped from the surface through the wellbore which causes stresses in the rock formation, the fluid pressure and pumping rate exceed the critical stresses resulting in fractures forming and propagating through the surrounding hot rocks. Further pumping leads to deeper fracture propagation in the vertical and horizontal directions. The fracturing fluid may comprise proppant material which fill the developing fractures preventing fractures closure and improve the conductivity through the fracture.

FIG. 1 shows three fractures 20, 22, 24 with different lengths. During each fracturing operation of the fractures 20, 22, 24, a distinct tracer 30, 32, 34, is added to each respective fracturing fluid. Samples are taken from the production well to determine which of any of the fractures 20, 22, 24 are in fluid communication with the production well 14. In the example shown in FIG. 1, none of the tracers 30, 32, 34 were detected in the production well indicating that there is no fluid communication between any of the fractures 20, 22, 24 and the production well. Based on the tracer data further fracturing operations may be conducted to extend the fracture lengths of fractures 20, 22, 24 or new fractures created. The tracer tests may be repeated to determine if any of the further operations have successful established a fluid connection with the production well. Using the tracer data any fractures which do not establish a fluid communication with the production well may be sealed or blocked to prevent lost circulation of geothermal fluids.

Figure 2:
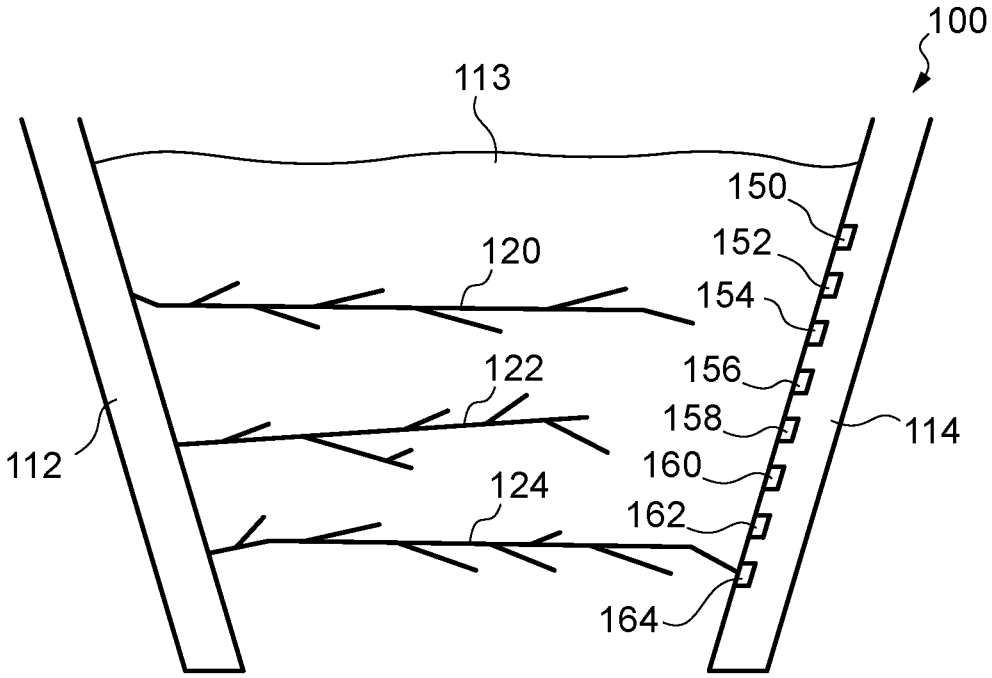
FIG. 2 is a simplified representation of a geothermal system in accordance with another aspect of the invention with multiple tracer sources arranged in the production well.

FIG. 2 is a simplified representation of an enhanced geothermal system according to the invention shown generally as 100. The geothermal system has an injection well 112 and a production well 114. The production well has multiple distinct tracer sources arranged a known positions or depths in the well. In this example eight tracer sources 150, 152, 154, 156, 158, 160, 162, 164 are installed in the production well. The tracer sources are inflow tracers. The inflow tracer sources are designed to release tracer to a specific target fluid. In this example the inflow tracer sources are designed to release tracer when in contact with water breaking though into the production well.

Similarly to FIG. 1 a series of hydraulic fracturing treatments are carried out in the injection well with the aim of establishing a fluid connection through the hot rocks 113 between the injection well and the production well. In this example hydraulic fracturing is carried out at three difference depths of the injection well. Samples are taken from the production well to determine if there is water breakthrough from any of the fractures 120, 122, 124 into the production well and determine the position or depth of the breakthrough in the production well. In this example shown in FIG. 2, only one inflow tracer, tracer 164 was detected in the production well indicating that there was only one breakthrough location at the position in the production well where the tracer source of tracer 164 is located.

Figure 3:
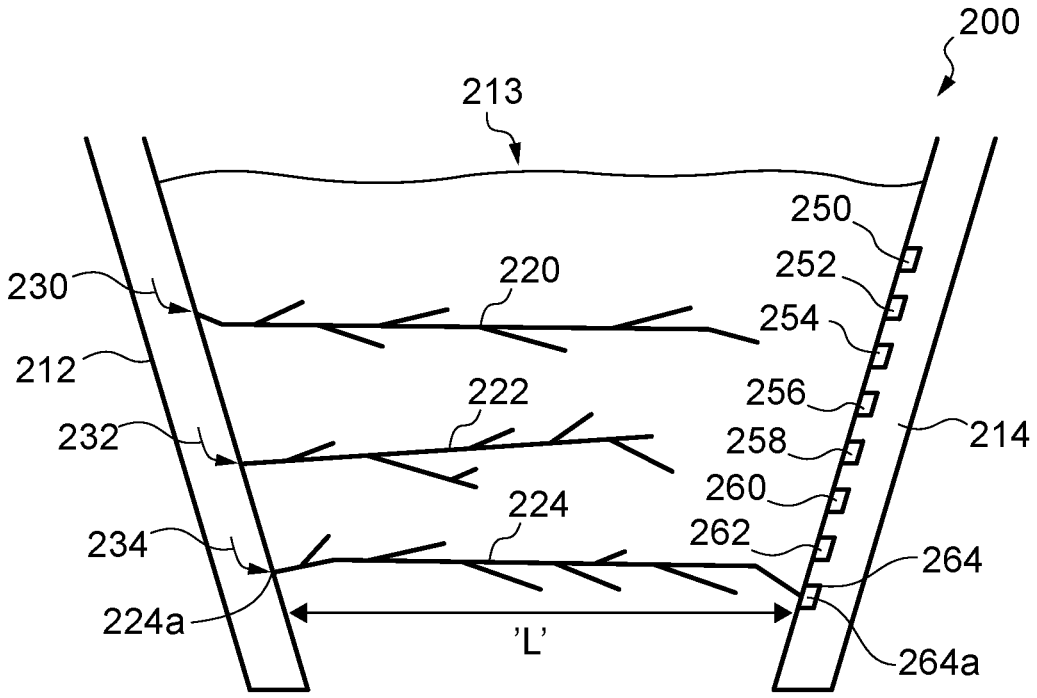
FIG. 3 is a simplified representation of a geothermal system in accordance with another aspect of the invention showing one fracture in connection with an injection well and production well.

FIG. 3 is a simplified representation of an enhanced geothermal system according to the invention shown generally as 200. The system 200 is similar to the systems 10 and 100 described in FIGS. 1 and 2 and will be understood from the description of FIGS. 1 and 2. However, the system 200 comprises interwell tracers injected into the injection well and an array of inflow tracer sources positioned in the production well.

The geothermal system 200 has an injection well 212 and a production well 214. A series of hydraulic treatments are carried out at different zones in the injection well. In this example three fractures 220, 222, 224 at created at different depths in the injection well. The production well has multiple distinct tracer sources arranged a known positions or depths in the well. In this example eight tracer sources 250, 252, 254, 256, 258, 260, 262, 264 are installed in the well. In this example the tracer sources are inflow tracers designed to release into produced water in the production well and identify the breakthrough location.

During each fracturing operation of fractures 220, 222, 224, a distinct tracer 230, 232, 234, is added to each respective fracturing fluid 213, 215, 217. In this example tracers 230, 232, 234 are interwell tracers and the fracturing fluid is water. Samples are taken from the production well to determine which of any of the fractures 220, 222, 224 are in fluid communication with the production well. Samples are taken from the production well to determine a breakthrough location from any of the fractures 220, 222, 224 into the production well. In this example shown in FIG. 3, interwell tracer 234 and inflow tracer 264 were detected in the production well. This indicates that fracture 224 has permeability through the hot rock formation 213 and the breakthrough location into the production well is the level or depth where tracer 264 is located. By further analysing the tracer data including arrival time and concentration of the tracers over time can provide information of the degree of permeability through the hot rock formation. If any inflow tracers are detected in the samples and no interwell tracers are detected in the samples it indicates that inflow into the production well is from a source which is not through fractures 220, 222 or 224.

By determining the depth where the fracture 224 breakthrough is located in the production well the fracture length shown as arrow "L" in FIG. 3, may be determined using the known injection point 224*a* in the injection well and the breakthrough point 264*a* in the production well. The fracture volume may also be calculated, in this example the flow rate (Q) was set at 5 cubic meters per hour ($m^3$/hour), representing the volume of fluid flowing through the fracture 224 per hour. The time to breakthrough (Tbt) was assumed to be 10 hours, indicating the duration for the tracer to travel from the injection point 224*a* to the production well at breakthrough point 264*a* at known depth in the vicinity of tracer 264. The fracture length (L) is 150 meters (m), representing the linear distance between the injection point 224*a* and production well breakthrough point 264*a*. This information is used to calculate the flow velocity, cross-sectional area, and fracture volume in cubic meters ($m^3$).

The flow velocity (v) is calculated using equation 1. The fracture length (L) is divided by the time to breakthrough (Tbt). This assumes a constant flow velocity along the length of fracture 224. In this example the flow velocity is 15 m/hour (150 m/10 hours).

$$v=L/Tbt \quad \text{(Equation 1)}$$

The cross-sectional area (A) of fracture 224 is calculated using equation 2. The flow rate (Q) is divided by the flow velocity (v). This assumes a uniform cross-sectional area along the length of the fracture. In this example the cross-sectional area is 0.333 $m^2$ (5 m3/hour/15 m/hour).

$$A=Q/v \quad \text{(Equation 2)}$$

Fracture Volume (Vfrac) is calculated using equation 3. The fracture volume (Vfrac) is calculated by multiplying the cross-sectional area (A) by the fracture length (L). This assumes that the fracture maintains a consistent width and height along its entire length. In this example the fracture volume (Vfrac) is 49.95 $m^3$ (0.333 m2×150 m).

$$V\text{frac}=A\times L \quad \text{(Equation 3)}$$

The above calculation in this example assumes that the flow velocity is constant along the entire length of the fracture and a uniform cross-sectional area of the fracture. The calculation assumes a straight path from the injection point to the production point. To accommodate for variations in the flow velocity, cross-sectional area of the fracture, deviated paths, loss of tracer, tracer interactions, tracer reactions and/or non-homogenous fracture medium, the measured tracer data may be compared with a model as discussed in relation to FIG. 8 below.

Figure 4A:
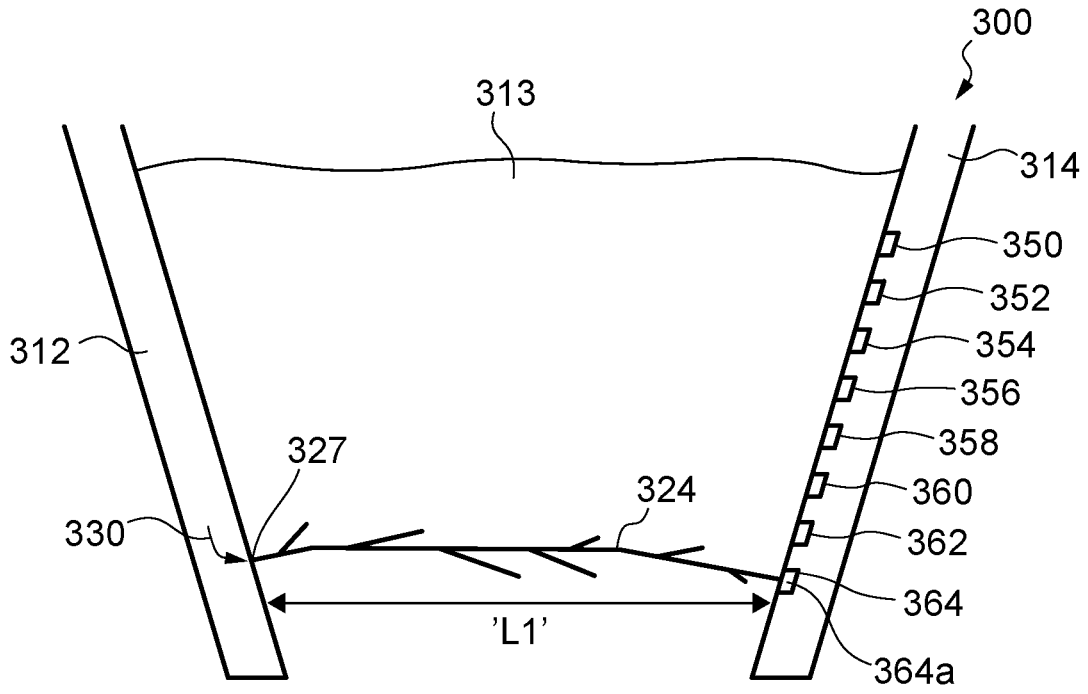
FIGS. 4A and 4B are simplified representations of a geothermal system in accordance with another aspect of the invention each showing possible fracture pathways connecting an injection well and a production well.
Figure 4B:
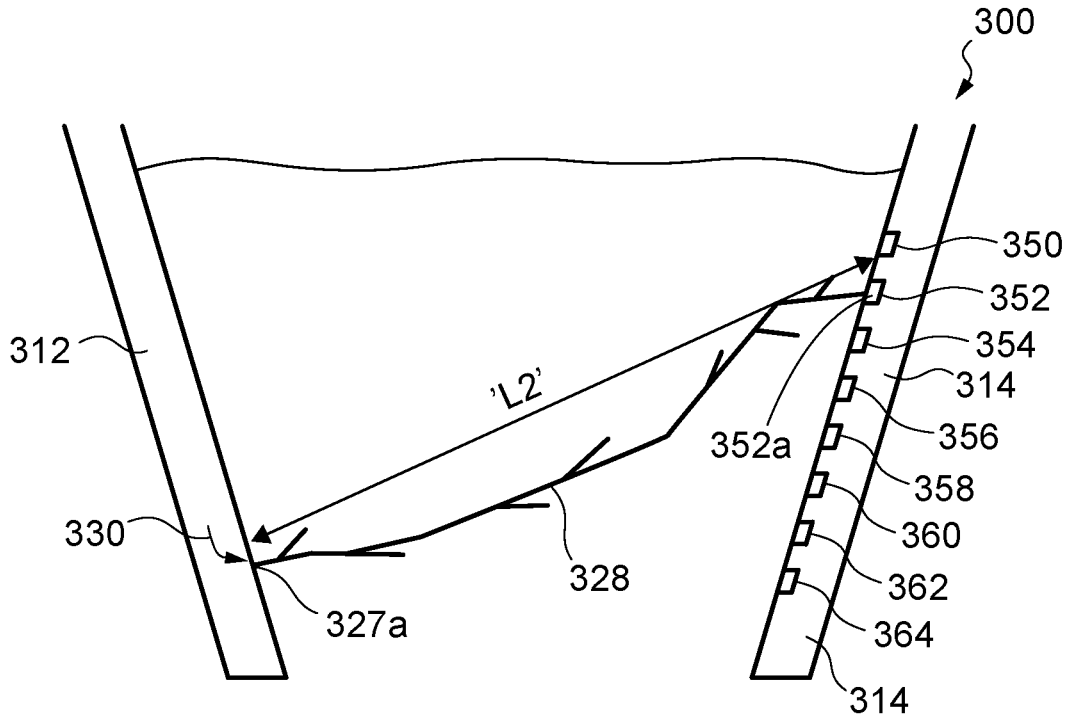

FIGS. 4A and 4B are simplified representations of enhanced geothermal system 300 showing two possible fracture paths 324 and 328 through the hot rock formation 313. The system 300 is similar to the system 200 described in FIG. 3 and will be understood from the description of FIG. 3.

FIGS. 4A and 4B show the geothermal system 300 has an injection well 312 and a production well 314. In this example one hydraulic treatment is performed and one fracture formation in the injection well is shown for clarity. In the example shown in FIG. 4A a fracture 324 is created at known injection point 327. During the fracturing operation a tracer 330 is added the fracturing fluid 313. The production well has multiple distinct tracer sources arranged a known positions or depths in the well. In this example eight tracer sources 350, 352, 354, 356, 358, 360, 362, 364 are installed in the well. The tracer sources in the production well are inflow tracer sources designed to release tracer from the tracer source positioned in the well when it contacts the injection fluid/fracturing fluid, in this example water. Samples are taken from the production well to determine a breakthrough location into the production well. In this example shown in FIG. 4A, interwell tracer 330 and inflow tracer 364 were detected in the production well. This indicates that fracture 324 has permeability through the hot rock formation 313 and the breakthrough location 364*a* into the production well is the level or depth where tracer 364 is located. By determining the depth where the fracture 324 breakthrough is located in the production well the fracture length shown as arrow "L1" in FIG. 4A, may be determined using the known injection point 327 in the injection well and the breakthrough point 364*a* in the production well 314. By further analysing the tracer data including arrival time and concentration of the tracers over time can provide information of the degree of permeability through the hot rock formation.

In contrast, FIG. 4B shows an alternative fracture path through the geothermal system 300. In the example shown in FIG. 4B the tracer data in the production well identified, interwell tracer 330 and inflow tracer 352 were detected in the production well 314. This indicates that fracture 328 shown in FIG. 4B has permeability through the hot rock formation 313 and the breakthrough location 352*a* into the production well is at the level or depth where tracer 352 is located. By determining the depth where the fracture 328 breakthrough into the production well is located the fracture length shown as arrow "L2" in FIG. 4B, may be determined using the known injection point 327*a* in the injection well and the breakthrough point 352*a* in the production well. It will be appreciated that there is a significant difference in the fracture length of fractures 324 and 328 which is identified by accurately determining their respective breakthrough locations in the production well 314.

Figure 5:
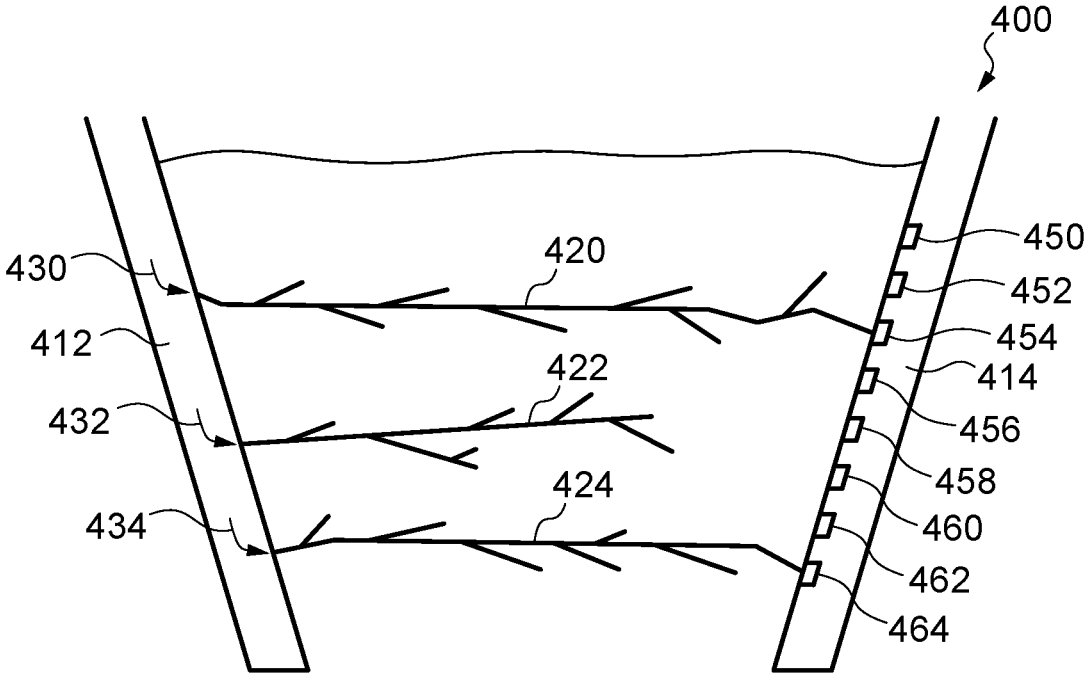
FIG. 5 is a simplified representation of a geothermal system in accordance with another aspect of the invention showing two fractures in connection with the injection well and production well.

FIG. 5 is a simplified representation of an enhanced geothermal system according to the invention shown generally as 400. The system 400 is similar to the system 200 described in FIG. 3 and will be understood from the description of FIG. 3. However, the tracer data from the produced fluids identified interwell tracer 434 and inflow tracer 464 initially.

Later a lower concentration of interwell tracer 430 and inflow tracer 454 were identified in the samples. This indicates that fracture 424 is permeable through the formation and its breakthrough location in the production well is at or in the vicinity of tracer source 464 in the production well. Similarly fracture 420 is permeable through the formation and its breakthrough location in the production well is at or in the vicinity of the tracer source 454 in the production well. The arrival of the tracer combination 430 and 454 in the production well before the tracer combination 434 and 464 and at a higher concentration indicates that fracture 424 has a higher permeability than fracture 420.

Figure 6:
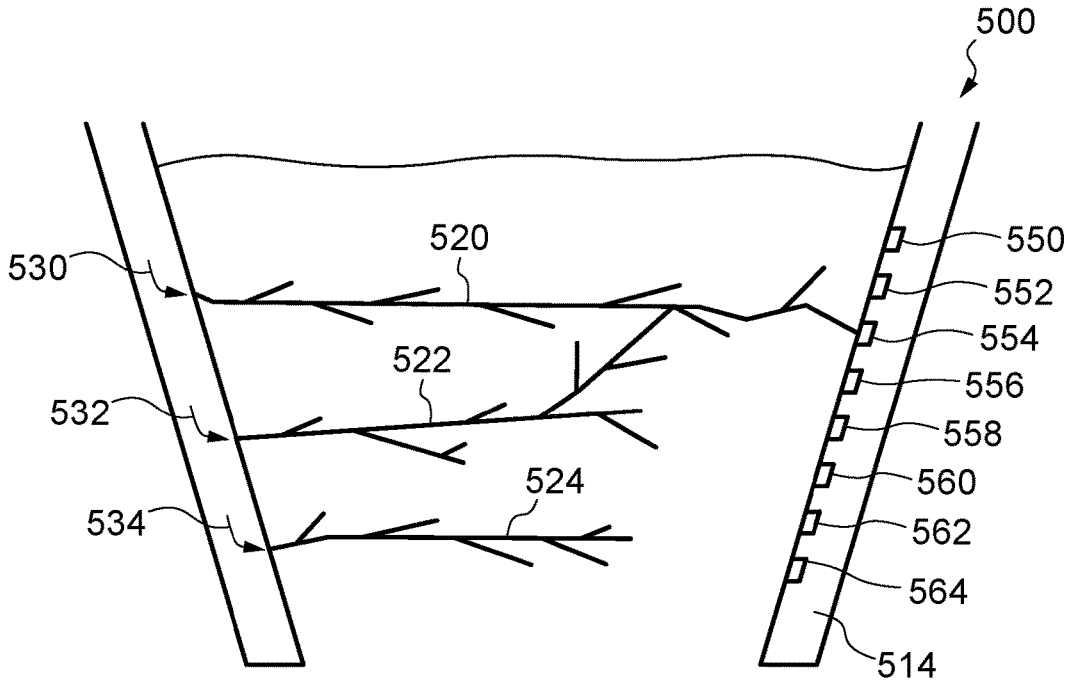
FIG. 6 is a simplified representation of a geothermal system in accordance with another aspect of the invention showing two cojoined fractures.

FIG. 6 is a simplified representation of an enhanced geothermal system according to the invention shown generally as 500. The system 500 is similar to the system 400 described in FIG. 4 and will be understood from the description of FIG. 5. However, the tracer data from the produced fluids in the production well detected interwell tracer 530 and inflow tracer 554 initially. Later a lower concentration of interwell tracer 532 was detected in the samples. This indicates that there is permeability of fractures 520 and 522 through the hot rock formation and that fractures 520 and 522 cojoin and breakthrough at or in the vicinity of tracer 554 in the production well. The delayed arrival of tracer 532 through fracture 522 into the production well when compared to tracer 530 in fracture 520 indicates that fracture 522 is a more convoluted flow path to the production well.

Figure 7:
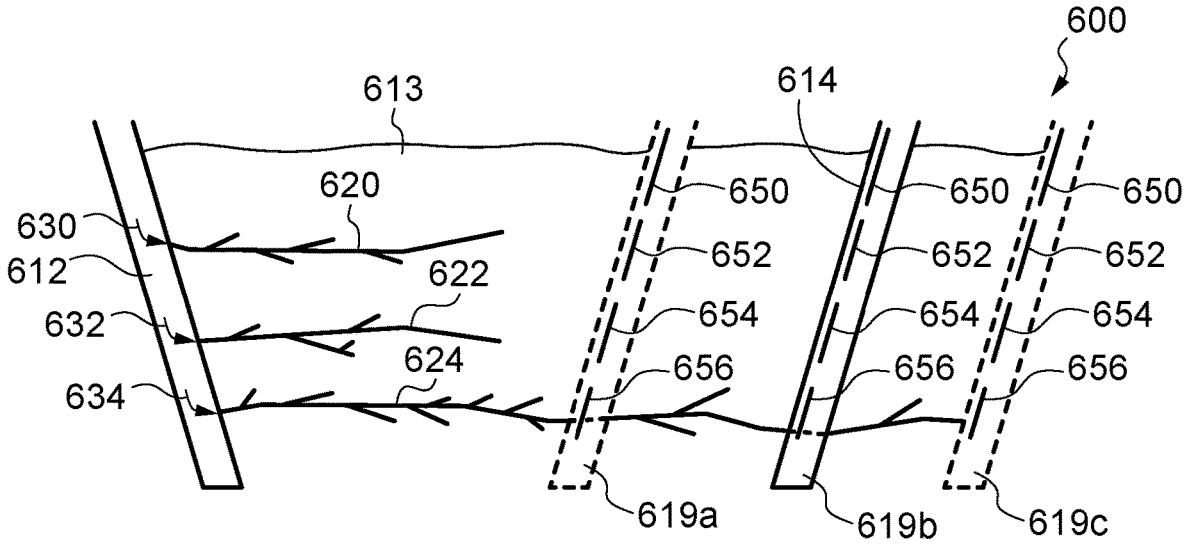
FIG. 7 is a simplified representation of a geothermal system in accordance with another aspect of the invention showing the construction of a geothermal system.

FIG. 7 shows stages of determining an optimum placement of a production well in an enhanced geothermal system according to the invention shown generally as 600.

An injection well 612 is first drilled and a series of hydraulic, thermal, or chemical stimulation treatments are carried out in the injection well with the aim of establishing a fluid connection between the injection well and the production well through the hot rocks 613. In this example hydraulic fracturing is carried out at three difference depths of the injection well. The distance between an injection well and a production well is important as the longer the distance the more exposure the circulating fluid has to the hot rock formation maximising the energy recovery from the enhanced geothermal system. A series of test wells 619*a*, 619*b*, 619*c* are drilled at increasing distances from the injection well, in this example, 300 m, 400 m and 500 m respectively. The test wells have multiple distinct tracer sources arranged at known positions or depths in the test wells. In this example four inflow tracer sources are shown 650, 652, 654, 656. The distance and/or location of the test wells may be determined based on the geological surveys or modelling data. FIG. 7 shows three fractures 620, 622, 624 at different depths in the injection well. During each fracturing operation of fractures 620, 622, 624, a different tracer 630, 632, 634, is added to each respective fracturing fluid. Samples are taken from each of the test wells 619*a*, 619*b*, 619*c* to determine connectivity between the fractures 620, 622, 624 and the test wells. In the example shown in FIG. 7, none of the interwell tracers 630, 632 or inflow tracers 650, 652 and 654 were detected in any of the test wells 619*a*, 619*b*, 619*c* indicating that there is no fluid communication between fractures 620 and 622 and the test wells. Interwell tracer 634 and inflow tracer 656 was detected in all test wells 619*a*, 619*b*, 619*c*. However, the recovery of injected interwell tracer 634 in each test well was 90%, 80% and 30% in test wells 619*a*, 619*b*, 619*c* respectively. The tracer data indicated that although test well 619*c* was in fluid communication with the injection well, the lower tracer recovery suggested poor connectivity and would result in a significant loss of circulation of geothermal fluids over time. The tracer data indicated that although there was a slight decrease in the tracer recovery in test well 619*b* compared with test well 619*a*, on balance the improved heat extraction capability of well 619*b* being an extra 100 m in distance from the injector well 619*a* combined with a high tracer recovery indicating high permeability identified well 619*b* as the optimal location for the production well 614. The production well 614 was established at the location of test well 619*b*.

Figure 8:
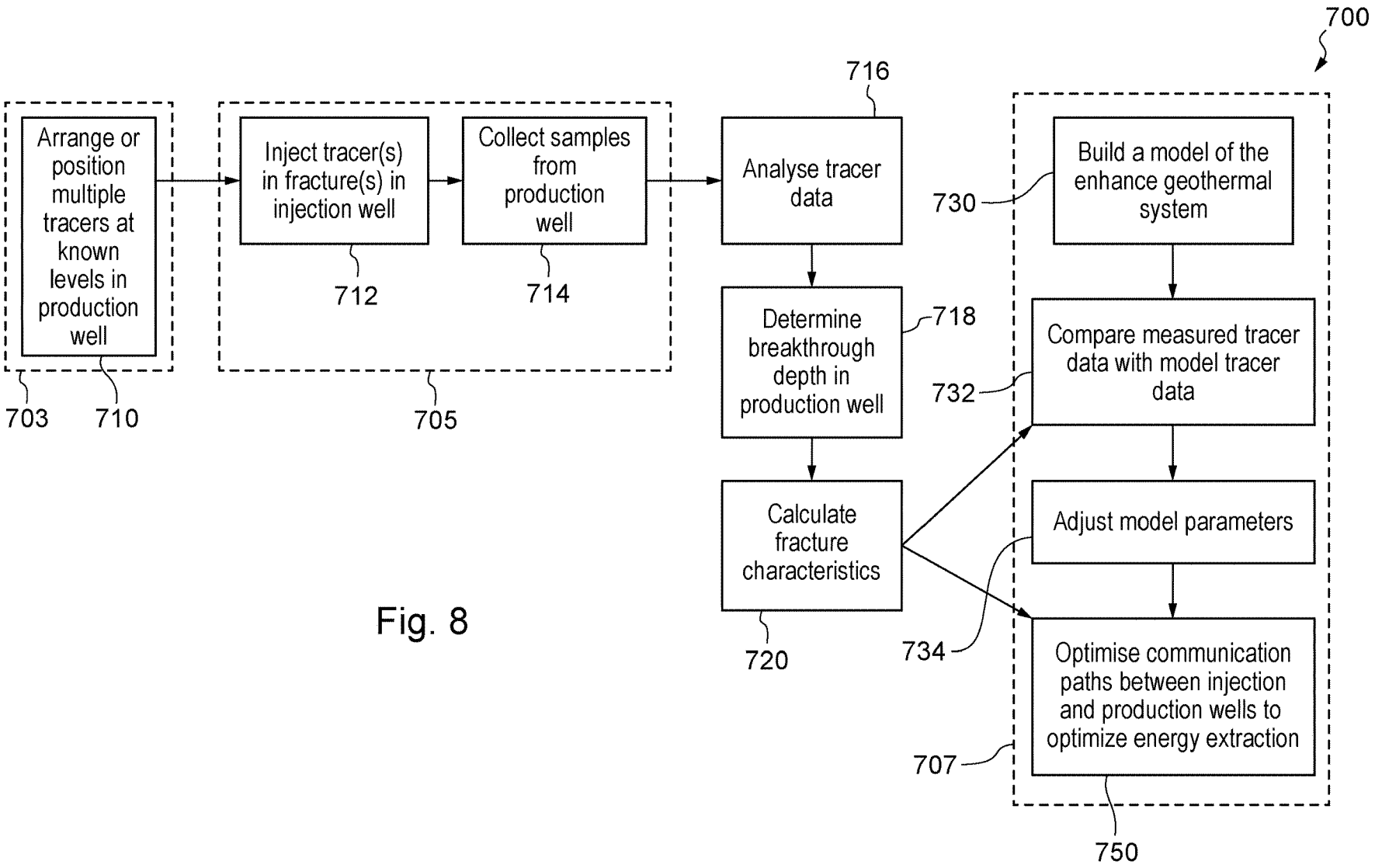
FIG. 8 is a flow chart showing steps for characterising at least one fracture of a geothermal system in accordance with an aspect of the invention.

FIG. 8 shows a flow chart 700 for characterising one or more fractures and optionally optimising energy extraction from an enhanced geothermal system. In a first step 710 multiple distinct tracers are installed or located at known positions of a production well. In this example the tracers are inflow tracers and are immobilized within and/or to a polymer carrier. The interaction of the tracer material and carrier is configured to release tracer molecules in the presence of a specific target fluid such as an injection or fracturing fluid. In this example the target fluid is water.

In step 712 a known amount of one or more distinct interwell tracers is injected into each fracture in an injection well. The interwell tracer may be injected with during or after a stimulation treatment at a known period of time. In this example the stimulation treatment is fracturing and a fracturing liquid is pumped into the wellbore. It will be appreciated that other stimulation treatments such as acidizing or acidizing fracturing may be used. In step 714 samples of the produced fluid in the production well are collected at known times at a known sampling location. In step 716 the sample data is analysed to determine the type of tracer present and/or tracer concentrations as a function of time. By identifying the type of inflow tracer present in the samples a breakthrough location and depth in the production well can be determined based on the known position of the source of the inflow tracer in the well. Characteristics of the fracture may be determined in step 720 from the breakthrough location including fracture length, cross-sectional area of fracture, flow velocity and/or fracture volume. The analysis step may also include tracer residence time distribution analysis, measuring the arrival time of each tracer and/or the sampling time, calculating an average travel time to the sample location and/or swept volume of the tracer through the fracture. This information may be used to understand flow and heat transfer capacity of the fracture to optimize energy extraction of the enhanced geothermal system (Step 750). Optionally, in step 730 a model may be created of the enhanced geothermal system. The model may comprise parameters comprising the injector well location, injection locations, fracture locations, fracture length, fracture depth, cross-sectional area of fracture, flow velocity and/or fracture volume, production well location, inflow tracer locations in the production well, and fracture paths through the hot rock formation. The method may comprise comparing the measured tracer data with the model tracer data at step 732. If the measured tracer data does not match a modelled tracer dataset for fracture characteristics, parameters may be tuned or iteratively adjusted at step 734 until the modelled tracer data substantially matches the measured tracer data to within a desired target range. The model and measured tracer information may be used to understand flow and heat transfer capacity of the fracture to optimize energy extraction of the enhanced geothermal system (Step 750).

The tracer installation in a production well, test well or well, tracer injection into at least one fracture or at least one injection well, collecting samples, analysis and/or interpretation of tracer data in produced fluids may be all be considered as separate methods from one another and performed at different times or jurisdictions. As denoted by the dotted box 703 the tracers may be installed or located at known positions of a production well as a separate method performed at different times or jurisdictions to other steps such as steps 712 and 714. As denoted by the dotted box 705 steps 712 and 714 may be considered as separate methods to step 703, the analysis and/or the interpretation of the tracer and may be performed at different times or jurisdictions. As denoted by the dotted box 707 the modelling steps may be optional and may be a separate method performed at different times or jurisdictions to other steps such as the tracer installation in a production well, test well or well, tracer injection into at least one fracture or at least one injection well, sample collection, tracer analysis and/or interpretation steps.

In the above examples the produced fluids may be liquid (condensed water) and/or gas/steam. The samples may be collected using containers such as bottles for capturing liquid samples. Gas/steam samples may be collected using containers such as chemical adsorption tube with an absorbent material to capture the tracers if present in the gas/steam.

The invention may provide a method and system of characterising at least one fracture in an enhanced geothermal system. The method comprises arranging two or more tracer sources with distinct tracer materials in known levels of a production well of the enhanced geothermal system. The method comprises injecting at least one tracer into the at least one fracture in the injection well, producing fluid in the production well, collecting samples of produced fluid and analysing the samples for the presence and/or concentration of tracers. Based on the presence and/or concentration of tracers in the samples estimating at least one characteristic of the at least one fracture.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers. Furthermore, relative terms such as "up", "down", "top", "bottom", "upper", "lower", "upward", "downward", "horizontal", "vertical", "extend", "retract" and the like are used herein to indicate directions and locations as they apply to the appended drawings and will not be construed as limiting the invention and features thereof to particular arrangements or orientations.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention as defined by the appended claims.

The invention claimed is:

1. A method of characterising at least one fracture in an enhanced geothermal system, the method comprising:

arranging two or more inflow tracer sources with distinct tracer materials in known levels of a production well of the enhanced geothermal system;

injecting at least one interwell tracer into the at least one fracture in an injection well of the enhanced geothermal system;

producing fluid in the production well;

collecting samples of produced fluid;

analysing the samples for the presence and/or concentration of tracers; and based on the presence and/or concentration of tracers in the samples estimating and/or calculating at least one characteristic of the at least one fracture.

2. The method according to claim 1 wherein the two or more tracer sources with distinct tracer materials are inflow tracers.

3. The method according to claim 1 comprising injecting the at least one interwell tracer into the injection well or at least one fracture before, during and/or after a well stimulation treatment.

4. The method according to claim 1 comprising injecting the at least one interwell tracer into the injection well or at least one fracture from surface, from a downhole device located in the injection well or from a tracer source positioned in the injection well.

5. The method according to claim 1 wherein the at least one interwell tracer is co-injected with a well stimulation treatment fluid.

6. The method according to claim 1 wherein the at least one interwell tracer is selected from the group consisting of chemical, fluorescent, phosphorescent and radioactive compounds isotope, isotope signature, stable isotope and/or radioactive isotope of elements constituting a part of a tracer molecule, a perfluorinated compound, an organofluorine compound with hydrogen replaced by fluorine, perfluorocarbon, a perfluoromethylcyclohexane, a nanoparticle, a quantum dot, naphthalene sulphonic acid.

7. The method according to claim 1 wherein the at least one tracer interwell and/or the two or more tracer sources with distinct tracer materials is a water tracer.

8. The method according to claim 1 wherein the two or more tracer sources with distinct tracer materials comprises a tracer and a carrier.

9. The method according to claim 8 wherein the two or more tracer sources with distinct tracer materials and/or the carrier is fluid specific such that tracer molecules will be released from the tracer material as a response to a contact with a target liquid.

10. The method according to claim 1 wherein the two or more tracer sources with distinct tracer materials is selected from the group consisting of chemical, fluorescent, phosphorescent, magnetic, DNA and radioactive compounds; the tracer material comprises chemical tracers selected from the group comprising perfluorinated hydrocarbons or perfluoroethers, perfluoro buthane (PB), perfluoro methyl cyclopentane (PMCP), perfluoro methyl cyclohexane (PMCH), polyfunctionalized polyethylene and/or polypropylene glycols.

11. The method according to claim 1 comprising identifying, tracing and/or mapping flow paths and/or transport paths of the at least one fracture.

12. The method according to claim 1 comprising characterising one or more breakthroughs into the production well based on the presence of tracers in the samples.

13. The method according to claim 1 comprising estimating and/or calculating at least one characteristic of the at least one fracture, where the characteristic is selected from the group consisting of breakthrough location, breakthrough depth, fracture length, flow velocity, cross-sectional area, fracture flow path, fracture volume, surface area, heating capacity, permeability, flow characteristics and/or flow path.

14. The method according to claim 1 comprising collecting samples at one or more sampling times.

15. The method according to claim 1 comprising detecting the presence and/or concentration of tracer in the produced fluid using an online analyser.

16. The method according to claim 1 comprising collecting samples in at least one sampling tube comprising a sorbent material.

17. The method according to claim 1 comprising measuring and/or monitoring a transport time of the at least one interwell tracer.

18. The method according to claim 1 comprising determining a heating capacity of the enhanced geothermal system by estimating a surface area of the at least one fracture and/or a migration path of fluid through the at least one fracture.

19. The method according to claim 1 wherein the injection well comprises two or more fractures and the method comprising injecting at least one distinct interwell tracer into each fracture.

20. A method of characterising at least one fracture in an enhanced geothermal system, the method comprising:

providing measured concentrations of tracer from samples of produced fluids, the samples previously collected from a production well of the enhanced geothermal system comprising two or more tracer sources with distinct tracer materials arranged in known levels of the production well, the samples collected after injecting at least one tracer into the at least one fracture in an injection well of the enhanced geothermal system; and based on the measured concentrations of tracer estimating at least one characteristic of the at least one fracture.

21. A system for characterising at least one fracture in an enhanced geothermal system comprising:

two or more tracer sources with distinct tracer materials configured to be arranged in known levels of a production well of the enhanced geothermal system;

at least one interwell tracer configured to be injected into the at least one fracture in an injection well of the enhanced geothermal system;

a sample collection device configured to collect samples of fluid produced in the production well.

22. The system according to claim 21 wherein the two or more tracer sources with distinct tracer materials are inflow tracers.

23. The system according to claim 21 further comprising at least one tracer analyser device configured to detect and/or measure a concentration of the at least one interwell tracer in fluid produced from the geothermal system.

* * * * *